United States Patent [19]

Herden et al.

[11] Patent Number: 4,636,690

[45] Date of Patent: Jan. 13, 1987

[54] SPARK PLUG FOR AN INTERNAL COMBUSTION ENGINE, HAVING A PILOT BREAKDOWN GAP

[75] Inventors: Werner Herden, Gerlingen; Boye Saggau, Schorndorf, both of Fed. Rep. of Germany

[73] Assignee: Robert Bosch GmbH, Stuttgart, Fed. Rep. of Germany

[21] Appl. No.: 649,989

[22] Filed: Sep. 13, 1984

[30] Foreign Application Priority Data

Sep. 20, 1983 [DE] Fed. Rep. of Germany ..... 3333891

[51] Int. Cl.[4] ..... H01J 7/44; H01J 13/46; H01J 19/78

[52] U.S. Cl. ..... 315/58; 315/56; 315/59; 315/63; 313/123; 313/142; 123/169 MG

[58] Field of Search ..... 315/58, 56, 59, 63; 123/169 MG; 313/140, 141, 143, 142

[56] References Cited

U.S. PATENT DOCUMENTS

| | | | |
|---|---|---|---|
| 2,900,575 | 8/1959 | Ramsay | 315/59 |
| 2,988,662 | 6/1961 | Smith | 315/58 |
| 3,030,549 | 4/1962 | Johnston | 315/58 |
| 3,124,718 | 3/1964 | Marks et al. | 315/58 |
| 3,191,133 | 6/1965 | Texsier | 315/58 |
| 3,267,325 | 8/1966 | Why | 315/58 |

FOREIGN PATENT DOCUMENTS

| | | | |
|---|---|---|---|
| 2363804 | 6/1975 | Fed. Rep. of Germany . | |
| 2810159 | 9/1979 | Fed. Rep. of Germany . | |
| 1307681 | of 1961 | France | 315/58 |
| 1297896 | of 1962 | France | 315/58 |

*Primary Examiner*—Palmer C. DeMeo
*Assistant Examiner*—M. Razavi
*Attorney, Agent, or Firm*—Frishauf, Holtz, Goodman & Woodward

[57] ABSTRACT

To increase the spark energy being transferred from a spark plug to a fuel-air mixture, so that the maximum energy transfer occurs during the initial breakdown phase and electrode deterioration at the spark plug is prevented upon occurrence of subsequent arc conduction and glow phases, an inductive circuit is connected in parallel to the spark gap which is so dimensioned that the inductance has a time constant which inhibits substantial current flow through the shunt circuit upon breakdown of the spark gap, but permits flow of current during an arc and glow phase of the spark at the spark gap through the shunt circuit so that energy is drained from the spark gap during the plasma and glow phase.

9 Claims, 2 Drawing Figures

SPARK PLUG FOR AN INTERNAL COMBUSTION ENGINE, HAVING A PILOT BREAKDOWN GAP

The present invention relates to a spark plug in which a pilot spark gap and a capacitor are connected to the spark plug.

BACKGROUND

It is desirable to improve combustion of air-fuel mixtures. Particularly when the mixtures are lean, difficulties in ignition may arise. German Patent Disclosure Documents DE-OS No. 23 63 804 and DE-OS No. 28 10 159 describe spark plugs which include a pilot breakdown gap in the spark plug circuit. The pilot breakdown gap controls discharge of a capacitor which is charged to provide spark breakdown energy. Lean air-fuel mixtures sometimes are difficult to ignite. Complete combustion of such lean mixtures which, upon combustion, will be low in environmentally undesirable exhaust, require substantial ignition energy. Conventional ignition systems, designed to be used with fuel-air mixtures which are richer than those which may be applied, may supply insufficient spark energy to the spark plug. Any one sparking event can be characterized by a plurality of individual phases. During the first or breakdown phase of the spark, the amount of energy changed from electrical to thermal, that is, to igniting energy, is a maximum. The remaining energy then results in an arc discharge through the plasma formed upon the original breakdown, with a subsequent glow discharge. Burning of the spark plug electrodes occurs especially during the plasma or second phase, rather than during the initial breakdown phase of the spark. It is, therefore, desirable to provide as much energy as possible during the initial breakdown phase, and to reduce the time during which the arc plasma and the glow phase extend, so that the wear and tear on the electrodes of the spark plug is reduced and hence the operating life as well as the time between "tune-ups" of the engine can be extended.

THE INVENTION

It is an object to improve a spark plug in such a way that the energy conversion from electrical to ignition energy of the fuel-air mixture is a maximum, and wear and burning of the electrodes of the spark plugs is reduced.

Briefly, the spark plug has a spark gap, a capacitor dischargeable over the spark gap, and a pilot breakdown gap which controls discharge of the capacitor. Further, a shunt circuit is provided which has an inductive component connected in parallel to the spark gap of the spark plug. The capacitor, the pilot breakdown gap, the inductive shunt circuit and the spark gap form a unitary spark plug structure.

The inductive component added to the circuit of the spark plug is so dimensioned that the time constant of the inductive circuit does not permit substantial rise in current to flow therethrough but, as soon as the major portion of the energy supplied to the spark plug has been converted to thermal and ignition energy, that is, at a time when in another spark plug not having the inductive component, an arc discharge and subsequently a glow discharge, that is, the second and third phases of the sparking event, would occur, the shunt circuit becomes effective to bleed off current through the spark gap, thus rapidly extinguishing the spark gap and preventing burning of the electrodes forming the spark gap of the spark plug. The inductance can be formed by a conductive path wrapped, for example, around the insulator tip of the spark plug in form of a wire, a conductive track, or the like, and of selected resistance to provide the desired time constant.

DRAWINGS

FIG. 1 is a schematic circuit diagram of a simplified ignition system for an internal combustion engine (ICE) of the Otto type, for example an automotive ICE; and FIG. 2 is a longitudinal sectional view through a spark plug in accordance with the present invention.

DETAILED DESCRIPTION

Figure 1:
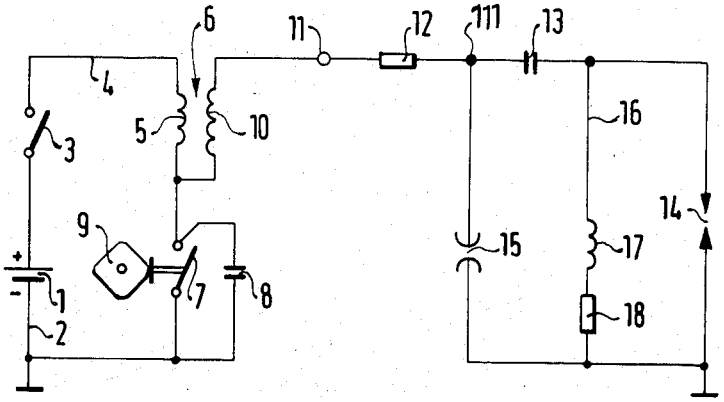
Figure 2:
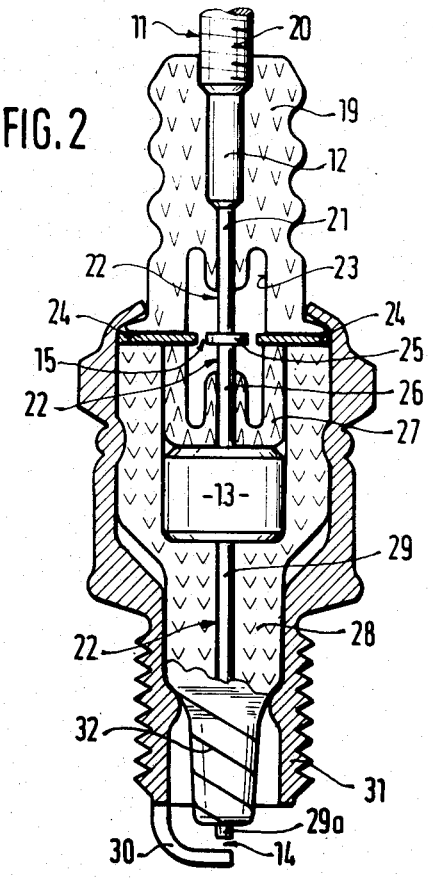

The spark plug of FIG. 2 is intended to be used in an ignition circuit for an Otto-type ICE, for example of a multi-cylinder automotive type, but it may be used also in other types of ICEs. The ignition system as shown in FIG. 1 has electrical energy supplied by a battery 1, for example the battery of an automotive vehicle, which has its negative terminal connected to ground or chassis of the vehicle, as shown by connection line 2. The positive terminal of the battery is connected through a main switch 3 to a positive supply line 4. Supply line 4 is connected to the primary winding 5 of an ignition coil 6. The primary winding of the ignition coil 6 is connected to a breaker switch 7, for example controlled by a distributor breaker 9, although of course the switch 7, which is shown as a mechanical switch, may be replaced by a semiconductor switch, and the entire system can be electronically controlled, as well known. The breaker or interruptor switch 7 is shunted by a capacitor 8 to suppress sparks at the breaker terminal. The ignition coil 6 has a secondary winding connected at one end to the primary 5, and the other to a high-voltage terminal 11 which, for example, may form a center terminal of a distributor or is the high voltage terminal for a spark plug of a single-cylinder ICE. The terminal 11 is connected through a radio suppression resistor 12 to a further high-voltage terminal 111. The radio suppression resistor 12 may be integrated in the spark plug, or can be integrated into a distributor rotor, for example.

The terminal 111 is connected to two branches, one branch being formed by a capacitor 13 and a spark gap 14, the other terminal of which is connected to ground or chassis; the other branch is connected to a pilot breakdown gap 15, the other terminal of which is likewise connected to ground or chassis.

In accordance with the present invention, a shunt circuit 16 is connected in parallel to the spark gap 14. FIG. 1 shows the equivalent electrical circuit, namely an inductive component 17 and a resistive component 18 which, together, form the shunt circuit 16. The resistor 18 may be a separate resistor or may, merely, represent the electrical resistance of the inductance wire or of the winding 17.

Capacitor 13, spark gap 14, pilot gap 15, and the inductive circuit 16 with the inductive component 17 and the resistive component 18, and, if desired, together with the radio noise suppression resistor 12, form a single structural unit which, in accordance with well known technology, can be screwed into a suitable opening in the cylinder housing of the ICE. The high-voltage terminal 11, or 111, as the case may be, is formed by a screw terminal or other projecting terminal 20 extending from an insulator 19—see FIG. 2—of a spark plug.

The noise suppression resistor 12 is connected with one terminal to the high-voltage terminal 11, and with its other terminal to a first portion 21 of a center electrode 22 located within the spark plug. The first portion 21 of the center electrode 22, which is rigidly secured within the insulator body 19, extends into a chamber 23 formed in the insulating body 19. The insulating body 19, which is a portion of the overall spark plug insulator, is of essentially cylindrical shape, symmetrically located about a theoretical longitudinal central axis passing through the center of the bolt 20 forming the high-voltage terminal 11, the rod or pin-like resistor 12, and the rod or pin-like portion 21 of the center electrode 22. Of course, it also corresponds to the center axis of the insulator portion 19.

The side of the insulator porton 19 remote from the high-voltage terminal 11 is flat, and is seated on a metallic disk 24 which concentrically surrounds a disk 25 secured to the center electrode 22, with a small gap therebetween. The space between the disk 25 and the ring disk 24 forms the pilot breakdown gap 15. The disk 25 is electrically and mechanically positioned between the first portion 21 of the center electrode 22 and a second portion 26 of the center electrode 22. For example, it may be press-fitted thereon, or otherwise secured to the center electrode 22. The second end portion of the second portion 26 of the center electrode 22 is connected to one terminal of capacitor 13. The second end portion of the center electrode 22 is securely seated in an insulating body 27 which, in cross section, is approximately U-shaped, so that the insulating element 27 defines therein a chamber facing the disk 25 and the ring structure or disk 24. Preferably, both insulating bodies 19, 27 have central beads projecting therefrom to additionally securely retain the center electrode, as seen in FIG. 2, so that the overall chamber defined by the two insulators, in cross section, is double-E-shaped, in which the Es face each other. Of course, since the entire structure is rotation-symmetrical, the portions of the chambers are all ring-shaped.

The insulator 27 and the capacitor 13 are fitted in a suitable opening located in a further insulator 28. Insulator 28 is also part-cylindrical, in which the cylinder diameter decreases, for example in steps, upon increase in distance from the terminal 11. The insulator 28 is rotation-symmetrical about the aforementioned longitudinal theoretical axis, and the capacitor 13 which, likewise, is preferably essentially cylindrical, is positioned about this axis. The second terminal of the capacitor 13 is connected to a third portion 29 of the center electrode 22, located in said central axis. The third portion is secured in the further insulator body 28, and, in the terminal end facing the high-voltage connection 11, is connected to the capacitor 13. The other end portion of the central connecting element or center electrode 22 forms a spark gap electrode 29 which extends from the end face of the insulator 28. The projecting tip, together with a bent-over counter or ground or chassis electrode 30, forms the spark gap 14. The center electrode 22 and the tip **29*a*** of the center electrode may be separate structural elements, electrically connected, to match the materials to their required use, at minimum material costs.

The counter electrode 30 extends from an end portion 31 of the spark plug, which is threaded, and which is formed with suitable internal ridges or beads or shoulders to retain the insulator 28. The insulator 28 is held against an internal ring shoulder, and seated within the metallic housing. The metallic housing is rolled in, or peened over at the top, surrounding the upper or first insulator 19 at a flange thereof to hold all the elements in securely compressed condition, as seen in FIG. 2. The conductive ring 24, preferably, is engaged by the housing 31, for example by outwardly extending deformable prongs, extending from the ring 24, to insure good electrical connection between the ring 24 and the housing 31 while permitting self-centering thereof within the housing without interfering with the rolling-over of the top end.

In accordance with a feature of the invention, a spiral 32 of electrically conductive material is placed over the end portion of the insulator 28, terminating with its upper end at an inner ring shoulder of the housing 31, so as to be electrically connected to the housing 31 thereat, and, at its other end, being electrically connected to the portion 29 of the center electrode 22, for example just inwardly of or to the tip portion **29*a*. The spiral 32 located in a gap between the insulator 28 and the end of the metal housing 31—see FIG. 2. The spiral 32 is made of such material that the spiral winding forms the inductive component, whereas the inherent resistance of the winding forms the ohmic component of the shunt circuit 16**.

The discharge circuit including elements 13, 14, 15 must be designed in view of high-frequency, high-voltage discharge: low inductance and low resistance.

Operation: Upon closing of operating switch 3, and rotation of the breaker contact cam 9, switch 7 will close, current will flow through the primary winding of the ignition coil 6 and, upon opening of the breaker switch 7, or, if a transistor ignition circuit is provided, upon other triggering of the ignition system, current is suddenly interrupted, which will cause a high-voltage pulse to be induced in the secondary winding 10 of the ignition coil 6. This high-voltage pulse 6 is conducted to a high-voltage terminal 11 and, through the resistor 12, capacitor 13 is charged until the pilot breakdown gap 15 breaks down. Upon breakdown of the gap 15, the capacitor 13 can discharge through the spark gap 14. No current will flow, at that time, through the shunt circuit 16 since the inductive component 17, in combination with the resistive component 18, has been so selected that the resultant time constant, initially, does not permit any substantial current flow therethrough. When the energy of the breakdown of the spark gap 14 has been converted to such an extent that plasma discharge or glow discharge will occur at the spark gap 14, the inductance of the circuit 16 will, however, have become effective to the extent that its conductivity permits current to flow until the spark gap 14, effectively, is short-circuited, with the resistive component 18 acting as a current-limiting resistor.

The ignition system also operates if the capacitor 13 is placed in the position of the pilot gap 15, that is, effectively across the spark gap 14, and the pilot gap 15 is connected between terminals 111 and the "hot" or top terminal of the spark gap 14, in other words, the elements 13, 15 being interchanged in position in the circuit of FIG. 1.

The system, regardless of how connected but preferably constructed as shown, since it is easiest to make it that way, has the advantage that, after the main portion of the spark energy has been converted to heat to ignite the fuel-air mixture in the cylinder of an ICE, subsequently still supplied energy which might cause arc discharge and/or glow discharge is drained over the shunt path circuit 16, formed by inductance 17, 18, thus reducing burning of the electrodes and extending life of the spark plug. The design operating characteristics are not affected so that overall ignition is improved over an extended period of time.

Various changes and modifications may be made within the scope of the inventive concept.

In an operative example, the end portion of the spark plug insulator 28 has an average diameter of 9 mm, and a length of 50 mm; the inductance 32 was formed for example by platinum of 1 to 2 winding loops or turns, and having an ohmic resistance of 0.2 ohms, to provide an inductance of 20 nH, with a time constant of 700 nanoseconds.

What is claimed is:

1. Spark plug, with post-breakdown-phase spark gap current suppression, for an internal combustion engine, including a metallic housing (31);

a spark gap (14) having a ground or chassis electrode (30) galvanically connected to the metallic housing and a center electrode (29,29*a*), a capacitor (13) dischargeable over the spark gap, and a pilot breakdown gap (15) controlling discharge of the capacitor (13), and means for suppressing current flow between said spark gap electrodes (29,29*a*; 30) after a breakdown phase of each spark across said spark gap, wherein, in accordance with the invention, said means for suppressing current flow comprises a shunt circuit having an inductive component (17) therein, the spark gap (14), the capacitor (13), the pilot breakdown gap (15) and the shunt circuit forming a composite unitary spark plug structure; and wherein the inductive component has an electrical galvanic connection with the metallic housing (31) and hence with the ground or chassis electrode (30), and further with the center electrode (29,29*a*) to provide effectively an electrical short circuit across the spark gap (14) for current flow through said shunt circuit after breakdown of the spark gap and during an arc and glow phase of the spark at the spark gap (14).

2. Spark plug according to claim 1, wherein the shunt circuit includes a resistive component, the time constant of the inductive-resistive component in the circuit with the spark gap, and the capacitor inhibiting substantial current flow through the shunt circuit upon breakdown of the spark gap (14) to convert the breakdown energy into spark energy, while permitting flow of current during an arc and glow phase of the spark at the spark gap through the shunt circuit, thereby draining energy from the spark gap during the arc and glow phase and reducing burning of the electrodes (30; 29, 29*a*) defining the spark gap.

3. Spark plug according to claim 1, wherein the parallel circuit defined by the spark gap (14) and the shunt circuit (16) are serially connected with the capacitor (13) to define a series circuit;

wherein the pilot breakdown gap (15) is connected in parallel with said series circuit and forms a junction (111) therewith;

and wherein said junction (111) forms a high-voltage connection for the spark plug.

4. Spark plug according to claim 1, wherein the spark plug has a central insulator (28);

and the inductive component defining the shunt circuit comprises a spiral winding (32) wrapped about the central insulator, and electrically connected to a housing (31) of the spark plug and the high-voltage terminal of the spark gap (14).

5. Spark plug according to claim 2, wherein the resistive component is formed by the inherent resistance of the inductive component.

6. Spark plug according to claim 1, wherein the spark plug includes a central insulator (28) leaving, at an end portion thereof, a gap between the insulator and the metallic housing, the center electrode (29, 29*a*) extending through the central insulator;

and wherein the inductive component comprises a conductor (32) wound about the central insulator and located in said gap, the conductor (32) having one end galvanically connected to the housing and another end connected to the center electrode.

7. Spark plug according to claim 6, wherein said another end of the conductor is connected to the center electrode adjacent an electrode end tip (29*a*) thereof.

8. Spark plug according to claim 6, wherein the shunt circuit includes a resistive component formed by the inherent resistance of said conductor (32), the inherent resistance of said conductor being selected and dimensioned to provide a time constant of the inductive-resistive component in the circuit with the spark gap, and the capacitor inhibiting substantial current flow through the shunt circuit upon breakdown of the spark gap (14) to convert the breakdown energy into spark energy, while permitting flow of current during an arc and glow phase of the spark at the spark gap through the shunt circuit, thereby draining energy from the spark gap during the arc and glow phase and reducing burning of the electrodes (30; 29, 29*a*) defining the spark gap.

9. Spark plug according to claim 8, wherein said another end of the conductor is connected to the center electrode adjacent an electrode end tip (29*a*) thereof.

* * * * *